US007775905B2

(12) United States Patent
Beach et al.

(10) Patent No.: US 7,775,905 B2
(45) Date of Patent: Aug. 17, 2010

(54) GOLF CLUB HEAD WITH REPOSITIONABLE WEIGHT

(75) Inventors: Todd P. Beach, San Diego, CA (US); Joseph H. Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 11/613,138

(22) Filed: Dec. 19, 2006

(65) Prior Publication Data

US 2008/0146370 A1 Jun. 19, 2008

(51) Int. Cl.
*A63B 53/06* (2006.01)

(52) U.S. Cl. ..... 473/334; 473/256

(58) Field of Classification Search ..... 473/324–350, 473/256

See application file for complete search history.

(56) References Cited

U.S. PATENT DOCUMENTS 3,979,123 A 9/1976 Belmont
4,795,159 A 1/1989 Nagamoto
4,803,023 A 2/1989 Enomoto et al.
5,121,922 A 6/1992 Harsh, Sr.
5,251,901 A 10/1993 Solheim et al.
5,297,794 A 3/1994 Lu
5,395,113 A 3/1995 Antonious
5,564,705 A 10/1996 Kobayashi et al.
5,613,917 A 3/1997 Kobayashi et al.
5,658,206 A 8/1997 Antonious
5,683,309 A 11/1997 Reimers
5,688,189 A * 11/1997 Bland ..... 473/314
5,720,674 A 2/1998 Galy
5,766,095 A 6/1998 Antonious
5,769,737 A 6/1998 Holladay et al.
5,776,010 A 7/1998 Helmstetter et al.
5,788,587 A 8/1998 Tseng
5,851,160 A 12/1998 Rugge et al.
5,911,638 A 6/1999 Parente et al.
5,913,735 A 6/1999 Kenmi
5,916,042 A 6/1999 Reimers
5,935,019 A 8/1999 Yamamoto
5,967,905 A 10/1999 Nakahara et al.
5,971,867 A 10/1999 Galy
5,976,033 A 11/1999 Takeda
6,015,354 A * 1/2000 Ahn et al. ..... 473/256
6,033,318 A 3/2000 Drajan, Jr. et al.
6,033,321 A 3/2000 Yamamoto
6,056,649 A 5/2000 Imai
6,062,988 A 5/2000 Yamamoto
6,077,171 A 6/2000 Yoneyama (Continued)

FOREIGN PATENT DOCUMENTS

EP 0470488 B1 3/1995

(Continued)

*Primary Examiner*—Alvin A Hunter
(74) *Attorney, Agent, or Firm*—Klarquist Sparkman, LLP

(57) ABSTRACT

A golf club head comprises a body, a track formed in or attached to the body and having a length and a weight and weight retainer. The weight is continuously repositionable such that it can be positioned at any selected point along the track between its ends. The weight has a major dimension, and the weight retainer comprises a fastening member having a diameter not greater than about one half of the major dimension of the weight.

25 Claims, 2 Drawing Sheets

U.S. PATENT DOCUMENTS 6,089,994 A 7/2000 Sun
6,123,627 A 9/2000 Antonious
6,162,132 A 12/2000 Yoneyama
6,171,204 B1 1/2001 Starry
6,190,267 B1 2/2001 Marlowe et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,277,032 B1 8/2001 Smith
6,290,609 B1 9/2001 Takeda
6,306,048 B1 10/2001 McCabe et al.
6,348,012 B1 2/2002 Erickson et al.
6,364,788 B1 4/2002 Helmstetter et al.
6,379,264 B1 * 4/2002 Forzano ..... 473/336
6,379,265 B1 4/2002 Hirakawa et al.
6,386,987 B1 5/2002 Lejeune, Jr.
6,409,612 B1 6/2002 Evans et al.
6,434,811 B1 8/2002 Helmstetter et al.
6,440,009 B1 8/2002 Guibaud et al.
6,440,010 B1 8/2002 Deshmukh
6,443,851 B1 9/2002 Liberatore
6,458,044 B1 10/2002 Vincent et al.
6,461,249 B2 10/2002 Liberatore
6,475,101 B2 11/2002 Burrows
6,475,102 B2 11/2002 Helmstetter et al.
6,508,978 B1 1/2003 Deshmukh
6,524,198 B2 2/2003 Takeda
6,530,848 B2 3/2003 Gillig
6,533,679 B1 3/2003 McCabe et al.
6,569,029 B1 5/2003 Hamburger
6,592,468 B2 7/2003 Vincent et al.
6,616,547 B2 9/2003 Vincent et al.
6,638,183 B2 10/2003 Takeda
6,641,490 B2 11/2003 Ellemor
6,648,772 B2 11/2003 Vincent et al.
6,652,387 B2 11/2003 Liberatore
6,716,111 B2 4/2004 Liberatore
6,719,641 B2 4/2004 Dabbs et al.
6,739,983 B2 5/2004 Helmstetter et al.
6,749,523 B1 * 6/2004 Forzano ..... 473/330
6,773,360 B2 8/2004 Willett et al.
6,773,361 B1 8/2004 Lee
6,805,643 B1 10/2004 Lin
6,808,460 B2 10/2004 Namiki
6,860,818 B2 3/2005 Mahaffey et al.
6,875,124 B2 4/2005 Gilbert et al.
6,881,158 B2 4/2005 Yang et al.
6,890,267 B2 5/2005 Mahaffey et al.
6,923,734 B2 8/2005 Meyer
6,926,619 B2 8/2005 Helmstetter et al.
7,147,573 B2 * 12/2006 DiMarco ..... 473/324
7,166,041 B2 * 1/2007 Evans ..... 473/334
7,201,669 B2 * 4/2007 Stites et al. ..... 473/337
7,520,820 B2 * 4/2009 Dimarco ..... 473/334
2005/0137024 A1 * 6/2005 Stites et al. ..... 473/291
2006/0122004 A1 * 6/2006 Chen et al. ..... 473/335
2006/0172821 A1 * 8/2006 Evans ..... 473/349
2006/0240908 A1 * 10/2006 Adams et al. ..... 473/334

FOREIGN PATENT DOCUMENTS

EP 0617987 B1 11/1997
JP 06238022 A * 8/1994
JP 2005296582 A * 10/2005
JP 2005323978 A * 11/2005
JP 2006320493 A * 11/2006

* cited by examiner

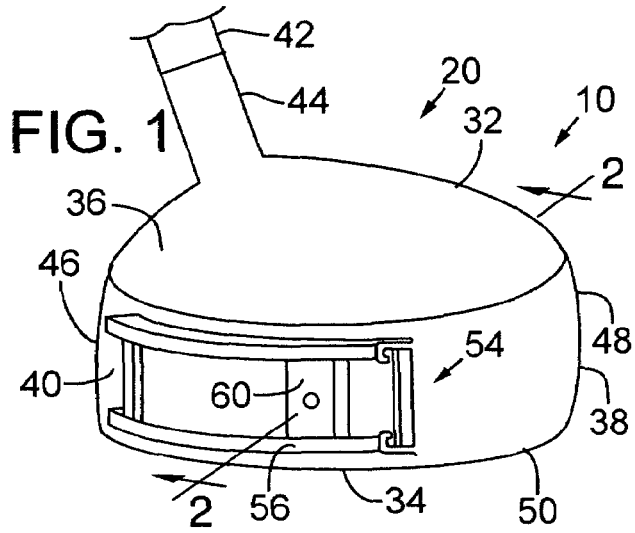
FIG. 1
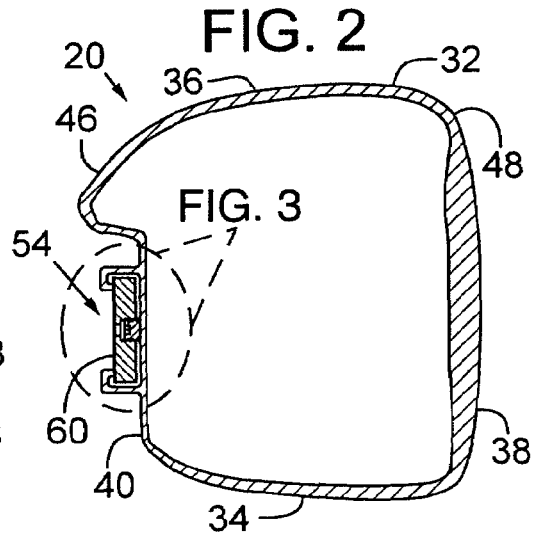
FIG. 2
FIG. 3
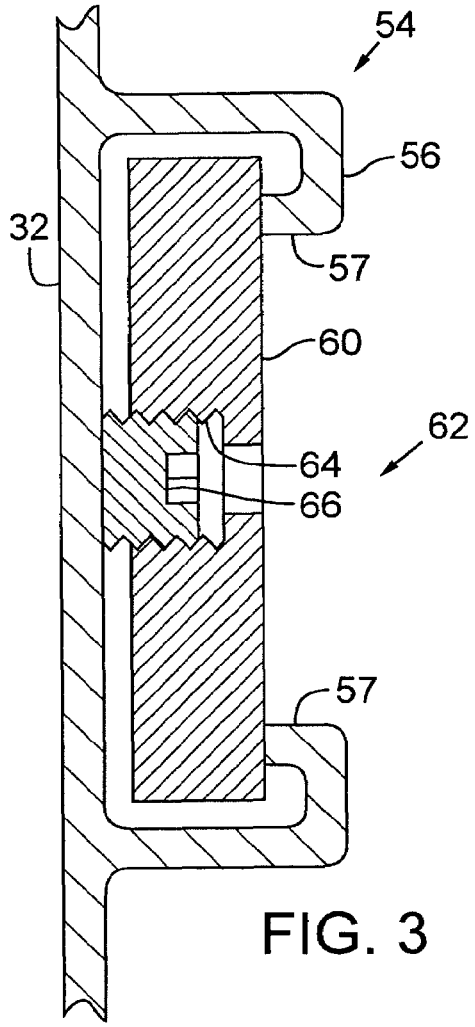
FIG. 3
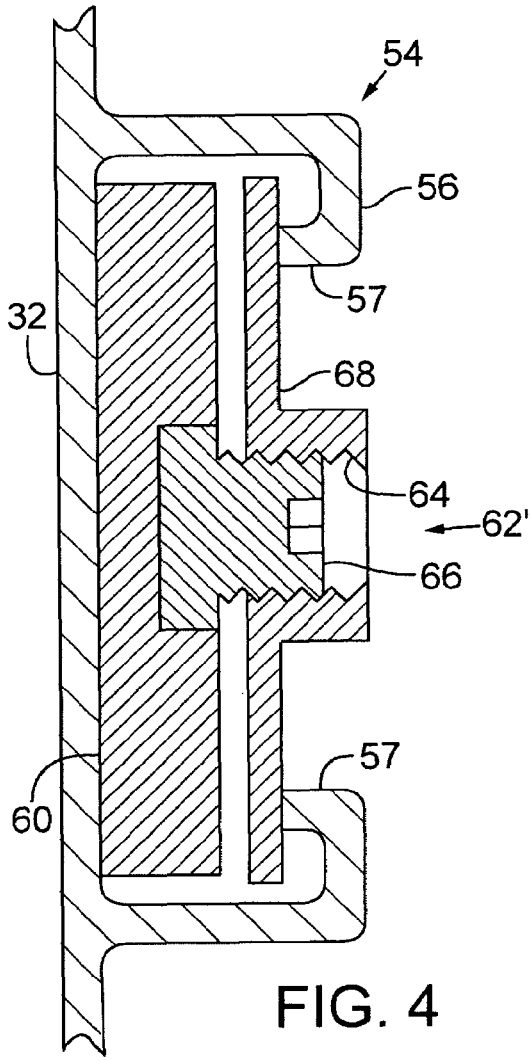
FIG. 4

GOLF CLUB HEAD WITH REPOSITIONABLE WEIGHT

FIELD

The present application is directed to a golf club head, particularly a golf club head having at least one repositionable weight.

BACKGROUND

The center of gravity (CG) of a golf club head is a critical parameter of the club's performance. Upon impact, the position of the CG greatly affects launch angle and flight trajectory of a struck golf ball. Thus, much effort has been made over positioning the center of gravity of golf club heads. To that end, current driver and fairway wood golf club heads are typically formed of lightweight, yet durable material, such as steel or titanium alloys. These materials are typically used to form thin club head walls. Thinner walls are lighter, and thus result in greater discretionary weight, i.e., the portion of the overall weight available for redistribution around a golf club head. Greater discretionary weight allows golf club manufacturers more leeway in assigning club mass to achieve desired golf club head mass distributions.

Various approaches have been implemented for positioning discretionary mass about a golf club head. Many club heads have integral sole weight pads cast into the head at predetermined locations to lower the club head's center of gravity. Also, epoxy may be added to the interior of the club head through the club head's hosel opening to obtain a final desired weight of the club head. To achieve significant localized mass, weights formed of high-density materials have been attached to the sole, skirt, and other parts of a club head. With these weights, the method of installation is critical because the club head endures significant loads at impact with a golf ball, which can dislodge a weight. Thus, such weights are usually permanently attached to the club head and are limited in total mass. This, of course, permanently fixes the club head's center of gravity.

Golf swings vary among golfers, but the total weight and center of gravity location for a given club head is typically set for a standard, or ideal, swing type. Thus, even though the weight may be too light or too heavy, or the center of gravity too far forward or too far rearward, the golfer cannot adjust or customize the club weighting to his or her particular swing. Rather, golfers often must test a number of different types and/or brands of golf clubs to find one that is suited for them. This approach may not provide a golf club with an optimum weight and center of gravity and certainly would eliminate the possibility of altering the performance of a single golf club from one configuration to another and then back again.

One approach to providing "movable weight" is seen in the TaylorMade r7 golf club product lines. In these golf clubs, weights having adjustable masses can be fitted to a fixed number of predetermined locations on the golf club head. This approach allows many fitting situations to be addressed, but there are still some circumstances in which golfers would appreciate greater flexibility.

SUMMARY

Disclosed below are representative embodiments that are not intended to be limiting in any way. Instead, the present disclosure is directed toward novel and nonobvious features, aspects, and equivalents of the embodiments of the golf club head having one or more movable weights.

According to some embodiments, the golf club head has at least one continuously repositionable weight, which is defined herein to mean a weight that can be positioned at any point within a defined area and is not limited to a finite number of predetermined positions. In other embodiments, the weight or weights are movable between multiple predetermined positions.

According to a representative embodiment, a golf club head comprises a body, a track formed in or attached to the body and having a length and at least one weight and a weight retainer. The weight is continuously repositionable such that it can be positioned at any selected point along the track between its ends. The weight has a major dimension and the weight retainer comprises a fastening member having a diameter not greater than about one half the major dimension of the weight.

The track can positioned generally in the aft portion of the club head. The track can be positioned generally within the ribbon of the club head.

The track can be a channel having two spaced apart channel walls and a bottom formed by an outer surface of the body. The channel walls can have an inverted "J" cross section defining hooked ends. The channel walls can be formed as a single piece with the body.

The weight can be dimensioned to be received and slidably movable within the track. Alternatively, the weight can be dimensioned to fit over the track.

The weight can comprise a pair of opposing legs and a channel-shaped track opening defined between the legs, with the track opening dimensioned to receive the track when the weight is positioned over the track with the leg portions straddling opposite sides of the track and bearing against the body at points outside of the track.

The weight can comprise a bore configured to threadedly receive the fastening member. The weight can be generally plate-shaped.

The track can be a channel, and the fastening member can be configured to extend through the bore in the weight and to tighten against an inner side of the channel, thereby pressing the weight outwardly against an outer side of the channel.

The weight retainer can comprise a retainer plate with a threaded bore dimensioned to receive the fastening member, and wherein the weight is positioned against an inner side of the channel, the retainer plate is positioned within and against the outer side of the channel and the fastening member is tightened to press the retainer plate outward against the channel and to press the weight inwardly against the inner side of the channel.

The fastening member can comprise a head end and an opposite end dimensioned larger than the channel opening, and wherein, with the opposite end of the threaded member received in the channel and threadedly received in the bore of the weight, the head end can be tightened to urge the weight toward the body and to urge the retainer plate toward an outer side of the channel. The weight retainer can also comprise a washer positioned between the opposite end of the fastening member and the channel, wherein the washer facilitates rotation of the opposite end relative to the channel when the fastening member is rotated.

The head can comprise a rib formed on the exterior of the body and having a generally T-shaped cross-section and a coupling member for coupling the rib to the opposite end of the fastening member. The coupling member can comprise a C-shaped coupler.

The fastening member can have a head end and an opposite end dimensioned to slide within the channel but larger than a channel opening of the channel.

The golf club head can comprise a body, a track formed in or attached to the body and having a length and a weight and coaxial weight retainer. The weight and the weight retainer are configured to exert at least two retaining forces at a selected position along the track in generally opposing directions, with one of the two forces being exerted in a direction toward the head and the other of the two forces being exerted in a direction away from the head.

The track can comprise a channel, and wherein the weight exerts a retaining force in a direction away from the head on an outer side of the channel and the weight retainer exerts a retaining force on the weight in a direction toward the head.

The weight retainer can comprise a fastening member and a retainer plate with a bore dimensioned to threadedly receive the fastening member, wherein the track comprises a channel, and wherein when the fastening member is tightened, the fastening plate exerts a retaining force in a direction away from the head on an outer side of the channel and the fastening member exerts a retaining force on the weight in a direction toward the head.

The disclosed features and aspects of the embodiments can be used alone or in various novel and nonobvious combinations and sub-combinations with one another.

BRIEF DESCRIPTION OF THE DRAWINGS

FIG. 1 is a schematic perspective view of a representative golf club head with a track and a continuously repositionable weight positionable at any desired point along the track.

FIG. 2 is a cross sectional view of the golf club head of FIG. 1 taken along the line 2-2 and showing a section of the head and the track in elevation.

FIG. 3 is a section view of a track and a weight secured in the track, according to one embodiment.

FIG. 4 is a section view of a track and a weight secured in the track, according to another embodiment.

DETAILED DESCRIPTION

Figure 5:
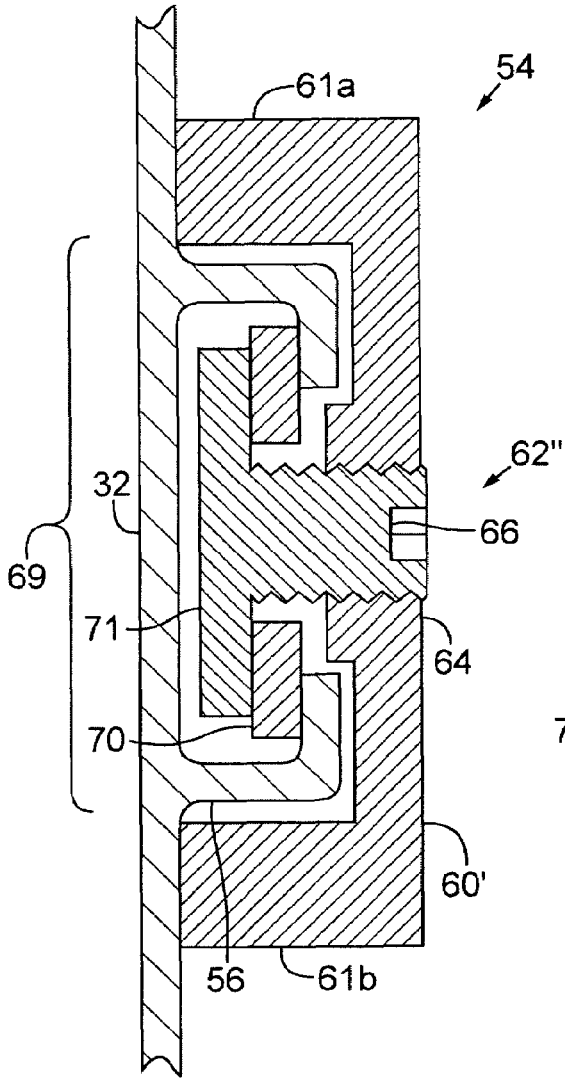
FIG. 5 is a section view of a track and a weight secured in the track, according to another embodiment.

A representative golf club 10 is shown in FIG. 1. The golf club 10 has a golf club head 20, which is attached to a shaft 42 (shown partially in FIG. 1), such as by a hosel 44. The golf club head 20 has a body 32 with a sole 34, a crown 36, a face 38 for striking the ball that extends between the crown 36 and the sole 34 at a fore end 48, and a ribbon 40 that comprises a portion of the body 32 between the crown 36 and the sole 34 at an aft end 46.

Referring to FIG. 1, the face 38 of the golf club head 20 is oriented toward the right, thus making a toe end 50 of the body 32 visible in the figure. A heel end of the body, although not shown in the figures, is generally opposite the toe end 50, and closer to the hosel 44.

The body 32 comprises a track 54, which can be described as being generally located in the ribbon 40 and closer to the aft end 46 than the fore end 48. Thus, if the aft end 46 and/or the ribbon 40 is curved, such as is shown for the representative head 20 of FIG. 1, the track 54 can extend along a curved path to follow its general shape.

FIG. 2 is a section view in elevation taken at the position shown in FIG. 1 and viewed in the direction of the arrows. As shown in FIGS. 1 and 2, the track 54 is configured to allow at least one weight 60 to be secured in place at a selected location along the track 54 to allow the club's characteristics to be changed as desired. The weight 60 is releasably secured, so that it remains in the selected location even after the golf club is subjected to use, but it can be removed or replaced when desired, such as to replace the weight, to remove the weight or to change the weight's position. In the illustrated embodiments, the weight is continuously repositionable, i.e., the track 54 allows the position of the weight 60 to be infinitely adjustable (secured at any selected position) along the length of the track between its ends and is not limited to being positioned in one of a finite number of predefined positions.

As shown in FIGS. 1 and 2, the track 54 in some embodiments protrudes from the surrounding surface of the body 32. In other embodiments, the track may be formed flush with the surrounding surface, or it may be recessed. In the illustrated embodiments, the track 54 is configured to retain the weight 60 within the track even if the weight is not yet secured in a selected position or has become unsecured. In this way, the chances of loss of the weight 60 (and other components), possible injury to others, and/or damage to property are reduced.

FIG. 3 is an enlarged view of a portion of FIG. 2 showing details of one implementation of the track 54 and weight 60. As shown in FIG. 3, the track 54 may comprise a channel 56 attached to or formed in the body 32 of the head 20. The channel 56 is comprised of a pair of spaced apart channel members 57 that protrude from the outer surface of the body 32 that can have hooked ends as shown. In other words, the channel members 57 can be described as having an inverted "J" profile. The channel 56 and the weight 60 are relatively dimensioned with respect to each other to allow the weight 60 to be moved to different points along the channel, such as by sliding the weight 60.

In the embodiment of FIG. 3, a weight retainer 62 retains the weight 60 in a selected position along the channel 56. The retainer 62 can be released to allow the weight 60 to be moved to a different position or removed from the channel (e.g., such as through an opened end of the channel). In the illustrated embodiments, the weight retainer 62 comprises a fastener, such as a threaded fastener or threaded section of a member, although other approaches are also possible.

For example, as shown in FIG. 3, the weight retainer 62 can comprise a fastener (such as, e.g., a set screw) or fastening member 66 that threadedly engages a bore 64 formed in the weight 60 to allow the weight 60 to be secured against an outer side of the channel (toward the aft direction) when the fastening member 66 is tightened against the inner side of the channel 56 (which may be the outer surface of the body). The fastening member 66 can have any suitable type of head (such as, e.g., a hex head or a TORX head) to allow use a tool for tightening or loosening the retainer 62.

The approach in FIG. 3 is suitable for many applications. A relatively large weight 60 may be suitably secured with the fastening member 66. For example, in some embodiments, the diameter of the fastening member 66 is not greater than one half of the major dimension of the weight 60. For additional security in some applications, the approach in FIG. 4, which allows the relatively heavy weight to be secured against a larger surface than in FIG. 3, can be followed.

Referring to FIG. 4, the weight 60 is secured by contact of its major surface with the base of the channel 56, rather than by contact between only the ends of the weight 60 and the channel 56 as shown in FIG. 3. Because of the greater surface area of the contact region, the weight 60 can be retained more securely. The head 20 experiences dramatic forces of about 10,000 G during impact with a golf ball. The effect of these forces in tending to loosen the weight retainer 62' is lessened because the weight is pressed against the head rather than being spaced apart from the head. This direct load transfer from the weight to the head is more efficient than having the load transferred through a smaller member, such as the weight retainer 62 shown in FIG. 3.

In FIG. 4, the weight retainer 62' comprises the fastener 66, configured to have its end free to turn and to bear against the weight 60, and a retainer plate 68 with the threaded bore 64 engaged with the fastener 66. When the fastener 66 is tightened, the weight 60 is pressed inwardly against the body 32, and the retainer plate 68, which is larger than the channel opening and not free to rotate, is pressed against the outer side of the channel 56. Because the weight 60 and retainer plate 68 are larger than the channel opening, these components will not separate from the head 20 if the weight 60 becomes unsecured.

Another alternative approach is shown in FIG. 5. In FIG. 5, a weight 60' is configured with a channel receiving opening 69 dimensioned to fit over the channel 56 as shown. The weight 60' has legs 61*a*, 61*b* shaped to straddle the channel 56 and to bear against the outer surface of the body 32 in areas outside of the channel 56, and is secured by the fastening member 66 threadedly engaged in the bore 64 in the weight. In the weight retainer 62", the fastening member 66 has an exposed or head end that can be driven by a tool and an opposite enlarged end 71 dimensioned larger than the channel opening. As the fastening member 66 is tightened, it tends to pull the weight 60' inwardly with the legs 61*a*, 61*b* bearing against the body 32 as shown. Optionally, a washer 70 can be placed between the exposed end of the fastening member 66 and the outer side of the channel 56 as shown to prevent wear and allow for easy tightening of the assembly.

Figure 6:
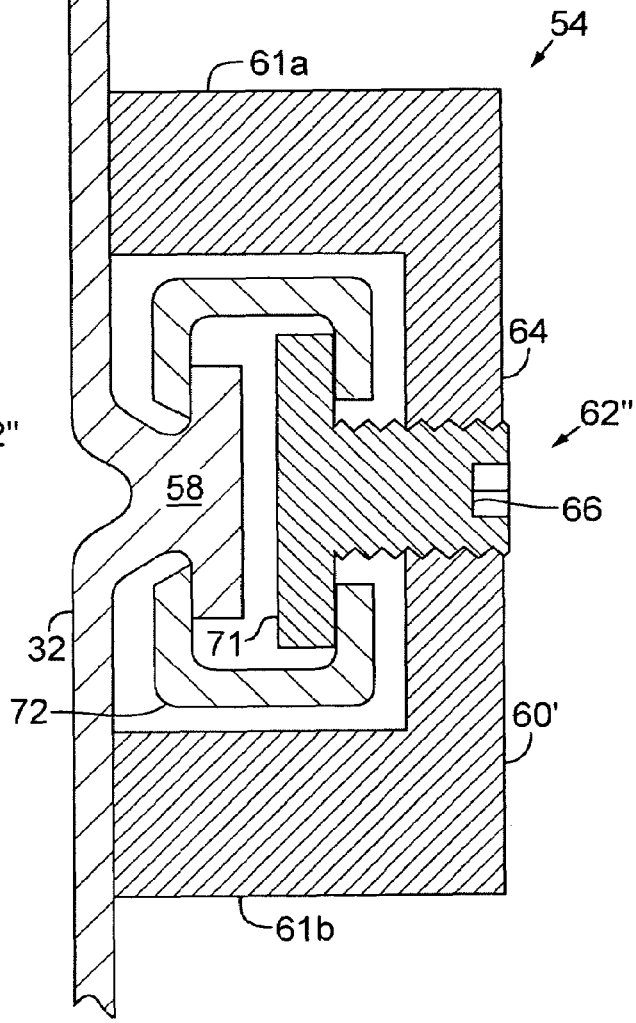
FIG. 6 is a section view of a track and a weight a track and a weight secured in the track, according to another embodiment.

FIG. 6 illustrates an approach similar to FIG. 5, except that the track 54 is formed as a rib or a rail 58 rather than the channel 56. In FIG. 6, there is a member 72, such as, e.g., a C-channel coupler as shown or another suitable construction, that couples the enlarged end of the fastener 66 (which is larger in size than the opening) to the rib 58. Similar to the FIG. 5 approach, when the fastener 66 is tightened, the weight 60' is pulled inwardly with the legs 61*a*, 61*b* bearing against the body 32.

Although described above in connection with a single weight, it is of course possible to use multiple weights that are individually secured in selected positions. In the illustrated embodiments, the concepts are shown for a driver, but it is possible to implement the same concepts for virtually any other type of club, including fairway woods, hybrid clubs, irons, putters, wedges, etc.

The weight or weights may be made from one or more materials, such as, e.g., steel, tungsten, titanium, copper, brass, aluminum, depleted uranium, magnesium, etc. The track and weight retainer can also be made of any suitable material, such as, e.g., titanium, aluminum, magnesium, composites or plastics. The track can be configured to allow complete removal of the weight, such as, e.g., at an end of the track.

Having illustrated and described the principles of the disclosed embodiments, it will be apparent to those skilled in the art that the embodiments can be modified in arrangement and detail without departing from such principles. In view of the many possible embodiments, it will be recognized that the described embodiments include only examples and should not be taken as a limitation on the scope of the invention. Rather, the invention is defined by the following claims. We therefore claim as the invention all possible embodiments and their equivalents that come within the scope of these claims.

What is claimed is:

1. A wood-type golf club head, comprising:

a body;

a track formed in or attached to the body and having a length;

a weight being adjustable to any selected point along the track between its ends, wherein the weight has a major dimension; and an axially captured fastening member for retaining the weight, the fastening member having a diameter not greater than about one half of the major dimension of the weight and an exposed end portion configured to be driven by a tool, wherein the weight comprises a bore configured to threadedly receive the fastening member, wherein the track is a channel having two spaced apart channel walls and a bottom formed by an outer surface of the body of the wood-type golf club head, and the channel walls have an inverted "J" cross section defining hooked ends.

2. The wood-type golf club head of claim 1, wherein the channel walls are formed integrally with the body.

3. The wood-type golf club head of claim 1, wherein the weight is dimensioned to be slidably movable within the track.

4. The wood-type golf club head of claim 1, wherein the fastening member is configured to extend through the bore in the weight and to tighten against an inner side of the channel, thereby urging the weight outwardly against an outer side of the channel.

5. The wood-type golf club of claim 1, further comprising:

a retainer plate with a threaded bore dimensioned to receive the fastening member, and wherein the weight is positioned against an inner side of the channel, the retainer plate is positioned within and against the outer side of the channel and the fastening member is tightened to press the retainer plate outward against the channel and to press the weight inwardly against the inner side of the channel.

6. The wood-type golf club head of claim 1, wherein the track extends along a curved path on a ribbon portion of the body.

7. The wood-type golf club head of claim 1, wherein the weight is generally plate-shaped.

8. A wood-type golf club head, comprising:

a thin walled body having a crown portion, a toe portion, a heel portion, and a sole portion;

a track formed in or attached to the body and having a length;

a weight and coaxial weight retainer, wherein the weight retainer comprises an axially captured fastening member having an externally threaded body and a retainer plate with a bore dimensioned to threadedly receive the fastening member;

wherein the weight and the retainer plate are configured to exert at least two retaining forces at a selected position along the track in generally opposing directions, with one of the two forces being exerted in a direction toward the head and the other of the two forces being exerted in a direction away from the head, wherein the track comprises a channel, and wherein the retainer plate exerts a retaining force in a direction away from the head on an outer side of the channel and the fastening member exerts a retaining force on the weight in a direction toward the head.

9. The wood-type golf club head of claim 8, wherein the track is positioned generally in an aft portion of the club head.

10. The wood-type golf club head of claim 8, wherein the body comprises a ribbon portion and wherein the track is positioned generally within the ribbon portion.

11. The wood-type golf club head of claim 8, wherein a position of the weight within the channel is continuously adjustable.

12. A wood-type golf club head, comprising:

a thin walled body having crown portion, a toe portion, a heel portion, a sole portion and a ribbon portion extending between the crown portion and the sole portion;

a track extending along a curved path and formed integrally with the thin walled body, the track is a channel having two spaced apart channel walls and a bottom wall formed by an outer surface of the thin walled body, the channel walls having an inverted "J" cross section defining hooked ends;

a weight disposed in the track and having a top weight surface and a bottom weight surface, the bottom weight surface being adjacent to the bottom wall of the channel and the top surface being adjacent to the hooked ends of the channel walls, the weight being slidably positionable along the track and having a threaded bore, the weight being continuously adjustable to any selected point along the track between its ends; and an axially captured fastening member having an externally threaded body disposed in the threaded bore, wherein the fastening member is configured to secure the weight at a position along the track and is configured to extend through the bore in the weight to engage against a bottom wall of the channel and to exert a retaining force in a direction toward the bottom wall of the channel, thereby urging the weight outwardly in an direction away from the bottom wall of the channel against the hooked ends of the channel, wherein the hooked ends of the channel engage the top weight surface of the weight in a peripheral region of the top weight surface.

13. The wood-type golf club head of claim 12, wherein the track is formed in the sole portion of the thin walled body.

14. The wood-type golf club head of claim 12, wherein the track is formed in the ribbon portion of the thin walled body.

15. The wood-type golf club head of claim 12, wherein the fastening member further includes a head to receive a tool.

16. The wood-type golf club head of claim 15, wherein the head comprises a hex head.

17. The wood-type golf club head of claim 12, wherein the weight is spaced away from the bottom wall of the channel upon the fastening member engaging the bottom wall of the channel.

18. The wood-type golf club head of claim 12, wherein the weight is entirely contained within the channel.

19. The wood-type golf club head of claim 12, wherein the outer side of the channel includes an engaging surface that engages the top weight surface, the weight being entirely disposed within a cavity defined by the channel walls, the bottom wall, and the engaging surface of the outer side of the channel.

20. The wood-type golf club head of claim 19, wherein the engaging surface of the outer side of the channel is substantially parallel to the top weight surface.

21. A wood-type golf club head, comprising:

a thin walled body having crown portion, a toe portion, a heel portion, a sole portion and a ribbon portion extending between the crown portion and the sole portion;

a track formed in or attached to the body and having a length, the track having a channel shaped track opening;

a weight being adjustable to any selected point along the track between its ends, wherein the weight has a major dimension; and an axially captured fastening member for retaining the weight, the fastening member having a diameter not greater than about one half of the major dimension of the weight and an exposed end portion configured to be driven by a tool, wherein the weight comprises a bore configured to threadedly receive the fastening member, wherein the weight is dimensioned to fit over the track and the weight comprises a pair of opposing legs and an opening defined between the legs, and wherein the opening is dimensioned to receive the track when the weight is positioned over the track with the leg portions straddling opposite sides of the track and bearing against the body at points outside of the track upon tightening of the fastening member, wherein the axially captured fastening member comprises a head end disposed in the weight bore and an opposite end dimensioned larger than the weight bore and disposed in the track opening, and wherein, with the opposite end of the fastening member received in the track opening and the head end threadedly received in the bore of the weight, the head end can be tightened to press the weight toward the body and to press the opposite end toward an outer side of the track.

22. The wood-type golf club of claim 21, wherein the weight retainer further comprises a washer positioned between the opposite end of the fastening member and the track, wherein the washer facilitates rotation of the opposite end relative to the track when the fastening member is rotated.

23. The wood-type golf club of claim 21, wherein the track comprises a rib formed on the exterior of the body and having a generally T-shaped cross-section and a coupling member for coupling the rib to an opposite end portion of the fastening member opposite the exposed end portion.

24. The wood-type golf club head of claim 23, wherein the coupling member comprises a C-shaped coupler.

25. The wood-type golf club head of claim 23, wherein the opposite end portion is dimensioned to slide within the track but larger than a track opening of the track.

* * * * *